United States Patent [19]

Besic et al.

[11] Patent Number: 4,965,042

[45] Date of Patent: Oct. 23, 1990

[54] INHERENTLY FLUSHING PISTON ROD FOR A RECIPROCATING PUMP

[75] Inventors: Dragan Besic, West Caldwell; Wilbur C. Smith, North Caldwell, both of N.J.

[73] Assignee: Dresser Industries, Inc., Dallas, Tex.

[21] Appl. No.: 474,156

[22] Filed: Feb. 2, 1990

Related U.S. Application Data

[62] Division of Ser. No. 307,401, Feb. 7, 1989.

[51] Int. Cl.[5] ..... F04B 21/00

[52] U.S. Cl. ..... 417/437; 417/900; 92/865

[58] Field of Search ..... 417/437, 439, 900; 92/86.5

[56] References Cited

U.S. PATENT DOCUMENTS 4,023,469 5/1977 Miller ..... 92/86.5

4,691,620 9/1987 Kao ..... 92/86.5

FOREIGN PATENT DOCUMENTS 1333371 6/1963 France ..... 417/437

*Primary Examiner*—Leonard E. Smith

*Assistant Examiner*—Robert N. Blackman

[57] ABSTRACT

An inherently flushing piston rod is provided for use with a reciprocating pump. A piston rod having a rod portion and a piston portion is mounted for reciprocating movement within the housing of the reciprocating pump. An axial bore is defined through the piston portion and the rod portion and fluidly connects the external environment of the rod portion to an internal chamber within the piston portion. Throughout the stroke of the piston, a flushing fluid is inherently drawn through the axial bore and into the internal chamber of the piston portion, and is subsequently delivered to a flushing space defined about the perimeter of the piston portion.

9 Claims, 4 Drawing Sheets

INHERENTLY FLUSHING PISTON ROD FOR A RECIPROCATING PUMP

This is a division of Ser. No. 307,401, filed Feb. 7, 1989.

FIELD OF THE INVENTION

This invention relates to a reciprocating pump, and, in particular, to a reciprocating pump having a piston rod which is inherently flushing throughout the cycle of the pump.

BACKGROUND OF THE INVENTION

Reciprocating pumps are commonly used to pump mixtures of liquids and solids for process and transportation purposes. Reciprocating pumps are particularly suited to these applications because of their relatively low velocities compared to centrifugal pumps. Lower velocity pumps are preferable for use in pumping mixtures of liquids and solids because erosive wear rates have been discovered to be proportional to a fairly high exponent (3 to 4) of the relative velocity of the pump. However, the close operating clearances required in reciprocating pumps, such as at the plunger or piston rod packing, are particularly subject to abrasive wear. For this reason, it has proven desirable to provide a flushing mechanism to reciprocating pumps in order to minimize the presence of abrasive particles in these close clearance areas.

SUMMARY OF THE INVENTION

The reciprocating pump of the present invention provides a piston rod which inherently flushes close clearance areas of the pump throughout the cycle of the plunger.

The inherently flushing piston rod of the present invention has a first rod portion, a piston portion, and a second rod portion coaxially mounted for reciprocating movement within a pump housing. An axial bore is formed through the first rod portion, the piston portion, and the second rod portion. An internal chamber is defined within the piston portion and is in fluid communication with the axial bore of the rod. Annular wiper elements are mounted on the piston portion and define an annular flushing space therebetween. A radially-extending channel extends through the piston portion between the internal chamber and the flushing space. A valve mechanism is disposed within the internal chamber of the piston portion in order to alternately close the entrances between the axial bores of the first and second rod portions and the internal chamber. As described in detail below, various means for providing flushing fluid to the axial bore at the first and second rod portions are included in the present invention. Further, the invention includes an inherently flushing piston rod for use in a double acting, reciprocating pump.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION

Figure 1:
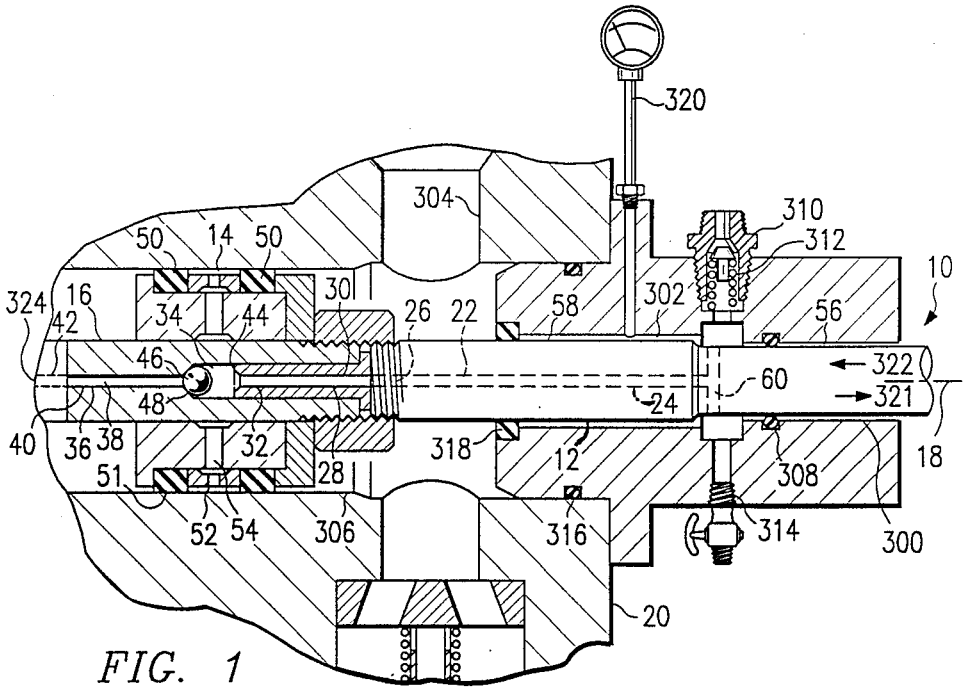
FIG. 1 is a partial cross-sectional view of the inherently flushing piston rod of the present invention mounted within the housing of a reciprocating pump.

An inherently flushing piston rod of the present invention is generally identified by reference numeral 10. Piston rod 10 includes a first rod portion 12. A piston portion 14, and a second rod portion 16 coaxially mounted along axis 18 for reciprocating movement through housing 20 of a reciprocating pump. It is to be appreciated that, in the preferred embodiments of the present invention, first rod portion 12, piston portion 14, and second rod portion 16 are circular in cross section and have predetermined diameters to facilitate their function.

An axial bore 22 having a first end 24 and a second end 26 is formed through first rod portion 12. A first axial bore 28 having a first end 30 and a second end 32 is formed through piston portion 14. First end 30 of first axial bore 28 is coaxially aligned with and fluidly interconnected to second end 26 of axial bore 22. Second end 32 of first axial bore 28 opens into and fluidly communicates with internal chamber 34 formed within piston portion 14. A second axial bore 36 is formed through piston portion 14. Second axial bore 36 is coaxial with axial bore 22 and first axial bore 28, and has a first end 38 and a second end 40. First end 38 of second axial bore 36 opens into and fluidly communicates with internal chamber 34 of piston portion 14. Second end 40 of second axial bore 36 is coaxially aligned with and interconnected to axial bore 42 of second rod portion 16. A flushing fluid source is provided to supply flushing fluid to axial bore 22 and axial bore 42.

A valve mechanism is provided in order to alternately close first axial bore 28 and second axial bore 36 of piston portion 1 with respect to internal chamber 34. In the preferred embodiment depicted in FIG. 1, a first seating area 44 is defined at the intersection of first axial bore 28 and internal chamber 34. A second seating area 46 is defined at the intersection of second axial bore 36 and internal chamber 34. Spherical member 48 is disposed within internal chamber 34 and is sized to provide a fluid-tight seal between internal chamber 34 and first axial bore 28 when seated in first seating area 44. Comparably, spherical body 48 is sized to provide a fluid-tight seal between second axial bore 36 and internal chamber 34 when positioned in second seating area 46. It is to be appreciated that any valve mechanism capable of providing the requisite alternating flow characteristics between first axial bore 28, second axial bore 36, and internal chamber 34 can be used in conjunction with piston portion 14 of the present invention. For example, check valves disposed within first axial bore 28 and second axial bore 36 may be used in lieu of first seating area 44, second seating area 46, and spherical body 48.

Annular wiper elements 50 are mounted on piston portion 14 and extend radially therefrom. Wiper elements 50 are dimensioned to permit reciprocating movement of piston portion 14 through housing 20 of a reciprocating pump. In a preferred embodiment, exterior surface 51 of wiper element 50 is inclined relative to piston portion 14, thus providing a relatively narrow wiping surface. Wiper elements 50, piston portion 14, and housing 20 define an annular flushing space 52. A radially-extending channel 54 is defined through piston portion 14 and fluidly connects internal chamber 34 and flushing space 52. In the embodiment depicted in FIG. 1, a plurality of radially-extending channels 54 are defined within piston portion 14 to provide fluid communication between internal chamber 34 and flushing space 52.

In the embodiment depicted in FIG. 1, first rod portion 12 has a distal end 56 and a proximal end 58. Distal end 56 has a reduced diameter relative to proximal end 58. Radially-extending channel 60 is defined in first rod portion 12. In the preferred embodiment depicted in FIG. 1, a plurality of radially-extending channels 60 are defined in distal end 56 of first rod portion 12. First end 24 of axial bore 22 terminates at and is fluidly interconnected to each radially-extending channel 60, thus providing fluid communication between the external environment of first rod portion 12 and axial bore 22.

Figure 2:
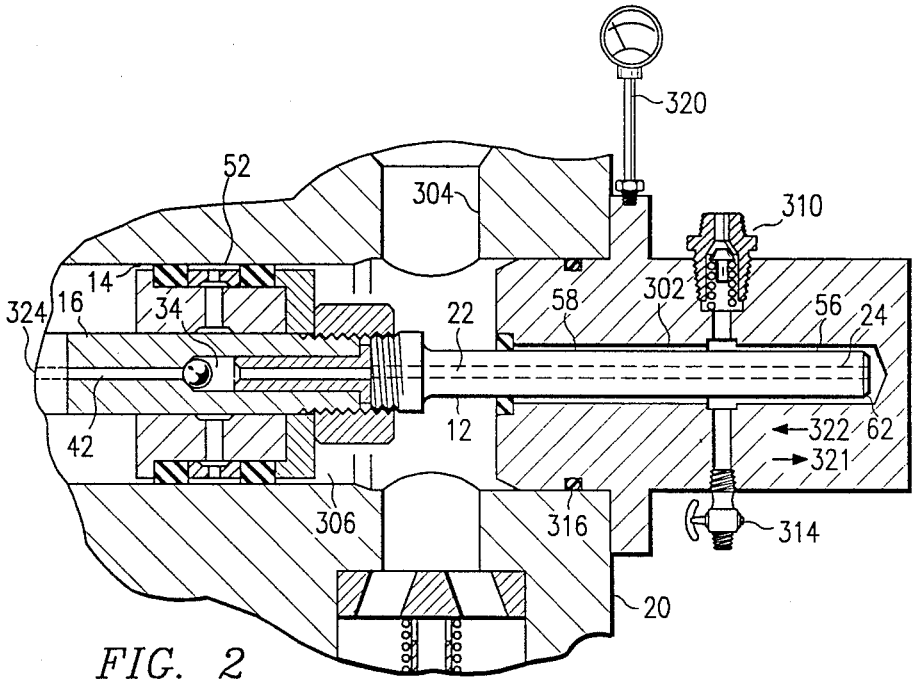
FIG. 2 is a partial cross-sectional view of a second preferred embodiment of the inherently flushing piston rod of the present invention mounted within the housing of a reciprocating pump.
Figure 4:
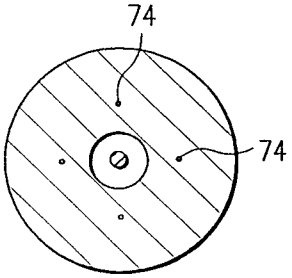
FIG. 4 is a cross-sectional view of the second preferred embodiment taken through line a—a of FIG. 3.

In the second preferred embodiment depicted in FIG. 2, first end 24 of axial bore 22 terminates at tip 62 of first rod portion 12 such that axial bore 22 is in fluid communication with the external environment of first rod portion 12. It is to be appreciated that, in this preferred embodiment, distal end 56 and proximal end 58 of first rod portion 12 have the same diameter.

Figure 3:
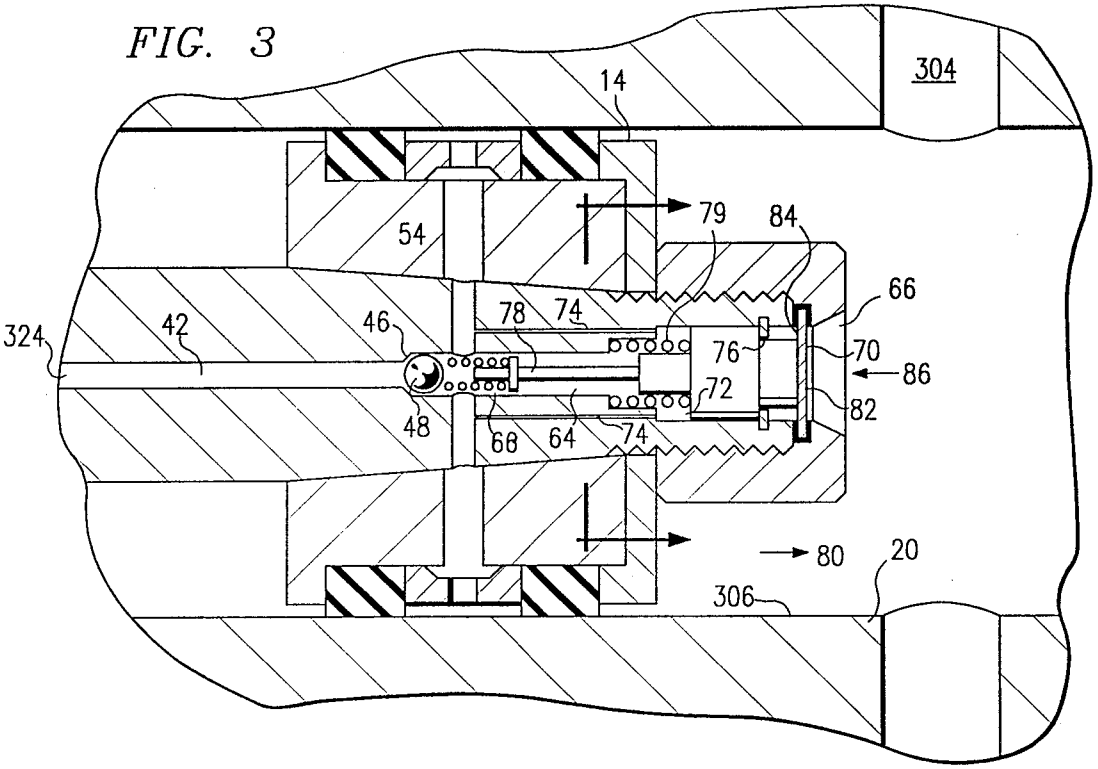
FIG. 3 is a partial cross-sectional view of a third preferred embodiment of the inherently flushing piston rod of the present invention mounted within a reciprocating pump.

In the third preferred embodiment depicted in FIG. 3, piston portion 14 has an axial channel 64 formed therethrough. Axial channel 64 has a first end 66 and a second end 68. First end 66 of channel 64 has a diameter greater than the diameter of second end 68 of axial channel 64. First end 66 is disposed such that it directly communicates with the external environment of piston portion 14. Diaphragm 70 is mounted in piston portion 14 across axial channel 64, thereby defining reserve flushing area 72. A plurality of channels 74 connect reserve flushing area 72 to radially-extending channels 54. Internal piston 76 is mounted for reciprocating movement in reserve flushing area 72. Internal piston 76 is connected to spherical body 48 by connector 78 such that internal piston 76 and spherical body 48 reciprocate substantially in unison through piston portion 14. Connector 78 also includes compression springs 79 which permit internal piston 76 and spherical body 48 to move relative to one another during reciprocation of the piston. Such relative movement is caused by pressure differentials developing during the cycle.

It is to be appreciated that when piston portion 14 of this preferred embodiment moves within housing 20 in the direction indicated by arrows 80, the pressure bearing on external surface 82 of diaphragm 70 will exceed the pressure bearing on interior surface 84 of diaphragm 70, thereby causing diaphragm 70 to distend in the direction indicated by arrow 86. Simultaneously, internal piston 76 will move in the direction of arrow 86 relative to piston portion 14 due to the distention of diaphragm 70, causing spherical body 48 to come into contact with second seating area 46, thus isolating axial channel 64 from axial bore 42. Concurrently, the movement of internal piston 76 in direction 86 causes flushing fluid contained in reserve flushing area 72 to be forced outwardly through radially-extending channels 54 into flushing space 52. When the piston portion 14 of this embodiment moves in the direction of arrow 86, diaphragm 70, internal plunger 76, and spherical body 48 will move in the direction indicated by the arrows 80 relative to piston portion 14 due to the resulting pressure differential across diaphragm 70, causing spherical body 48 to become dislodged from second seating area 46. Flushing fluid is then free to flow from the flushing fluid source, through axial bore 42, into reserve flushing area 72, and into flushing space 52.

Figure 5:
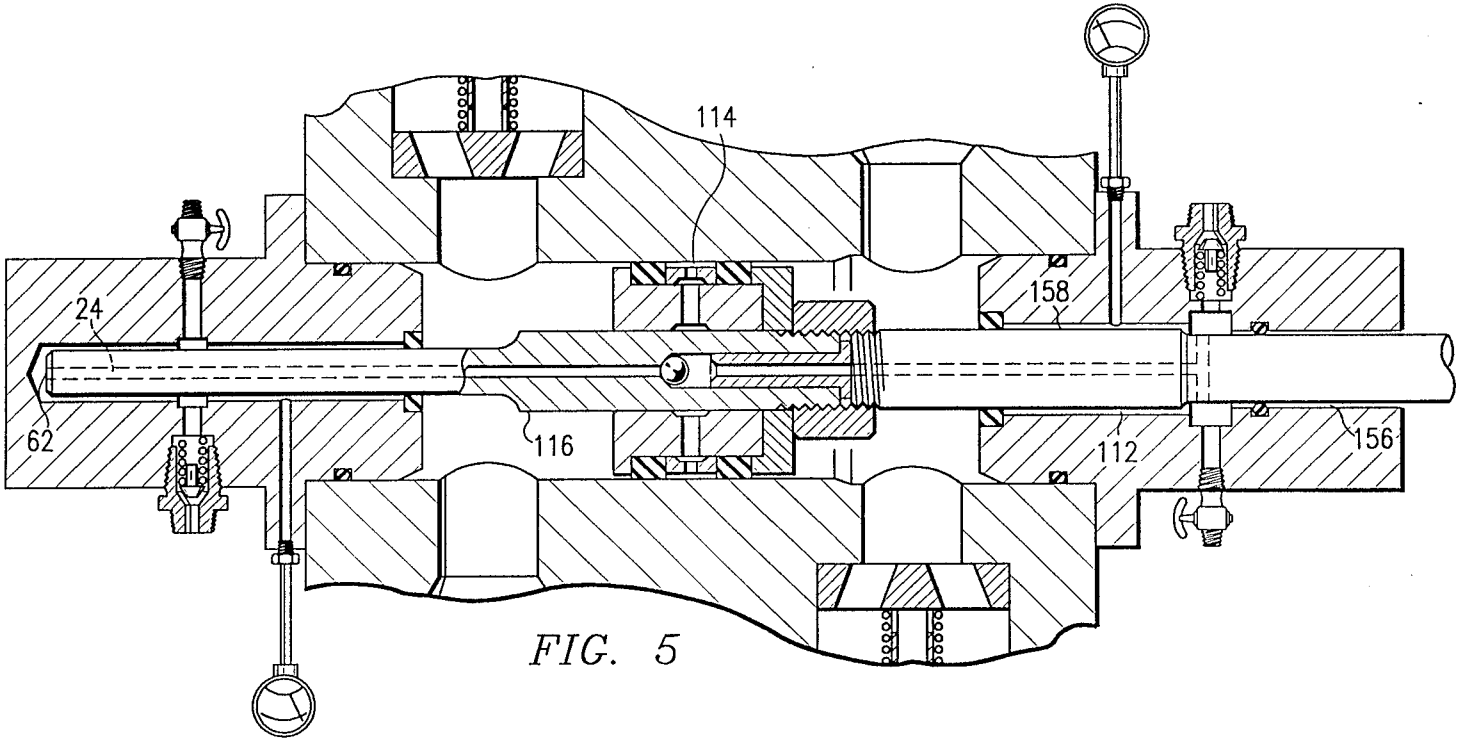
FIG. 5 is a partial cross-sectional view of a fourth preferred embodiment of the inherently flushing piston rod of the present invention mounted within a double acting, reciprocating pump.

In the preferred embodiment depicted in FIG. 5, piston portion 114 is constructed for use in a double-acting, reciprocating pump. In viewing this figure, it is to be appreciated that first rod portion 112 and piston portion 114 are identical to first shaft portion 12 and piston portion 14 of FIG. 1. Second rod portion 116 is identical in construction and function to first rod portion 12 of the preferred embodiment depicted in FIG. 2. In this embodiment, distal end 156 of first rod portion 112 is constructed such that it may be reciprocatingly driven by any known means for reciprocating.

Figure 6:
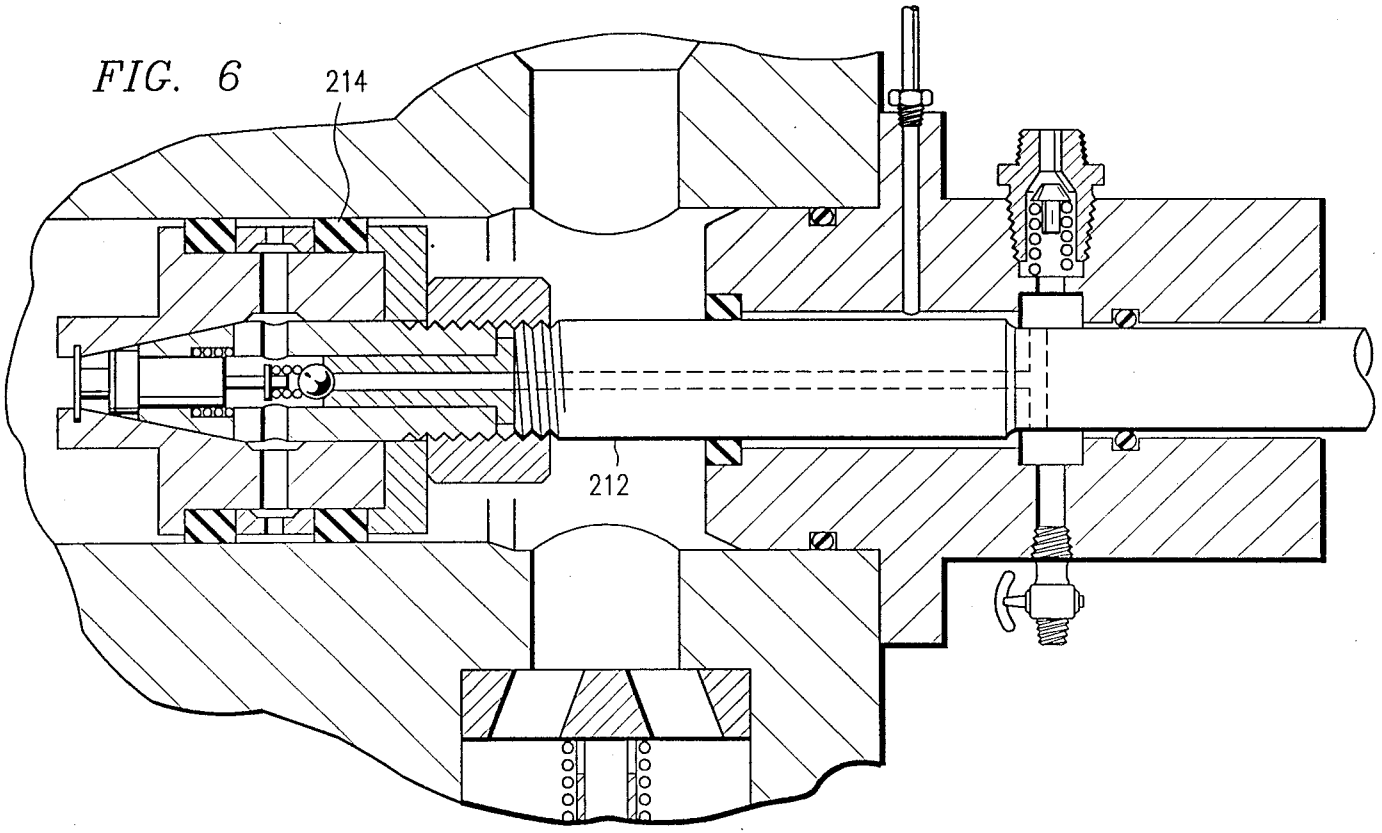
FIG. 6 is a partial cross-sectional view of a fifth preferred embodiment of the inherently flushing piston rod of the present invention mounted within a double acting, reciprocating pump.

In the preferred embodiment depicted in FIG. 6, piston portion 214 is again constructed for use in a double-acting, reciprocating pump. In viewing FIG. 6, it will be appreciated that first rod portion 212 is identical to first rod portion 12 of FIG. 1 and first rod portion 112 of FIG. 5. Piston portion 214 of this embodiment is identical to piston portion 14 of FIG. 3.

Referring again to FIG. 1, housing 20 of the reciprocating pump of the present invention includes a sealing chamber 300, a flushing chamber 302, a pumping channel 304, and a pumping chamber 306. Sealing chamber 300, flushing chamber 302, and pumping chamber 306 are coaxially mounted along axis 18. Sealing chamber 300, flushing chamber 302, and pumping chamber 306 preferably have circular cross-sections. The diameter of pumping chamber 306 is greater than the diameter of flushing chamber 302 and, in turn, the diameter of flushing chamber 302 is greater than the diameter of sealing chamber 300. 0-ring 308 is disposed about the periphery of sealing chamber 300 such that the interface between distal portion 56 of first rod portion 12 and 0-ring 308 forms a fluid-tight seal between sealing chamber 300 and flushing chamber 302. In addition, 0-ring 308 is sized to permit reciprocation of distal portion 56 of first rod portion 12 therethrough.

Flushing fluid source 310 is disposed in fluid contact with flushing chamber 302. Unidirectional valve 312 is provided to prevent flushing fluid flow from flushing chamber 302 to flushing fluid source 310. Flushing fluid drain 314 is connected to flushing chamber 302 and may be used to remove flushing fluid from flushing chamber 302 as desired. 0-ring 316 and annular seal 318, in combination with proximal end 58 of first rod portion 12, provide a fluid-tight seal between flushing chamber 302 and pumping channel 304. Annular seal 318 is sized to permit reciprocating movement of distal end 58 cf first rod portion 12 therethrough. Pressure gauge 320 may be connected to flushing chamber 302 whereby the pressure of flushing fluid in flushing chamber 302 can be readily determined.

In use, distal end 56 and proximal end 58 of first rod portion 12 reciprocate through flushing chamber 302. When first rod portion 12 moves in the direction indicated by arrow 322, there is an increase of the volume defined between flushing chamber 302 and first rod portion 12 due to the reduced diameter of distal end 56 of first rod portion 12 relative to the diameter of proximal end 58 of first rod portion 12. This increase in volume decreases the pressure within flushing chamber 302, causing flushing fluid to be drawn from flushing fluid source 310 into flushing chamber 302. Subsequently, as first rod portion 12 moves in the direction indicated by arrow 321, there is an increase in pressure within flushing chamber 302, causing unidirectional valve 312 to close and forcing flushing fluid from flushing chamber 302 into radially extending channels 60 and into axial bore 22 of first rod portion 12. The flow of flushing fluid through axial bore 22 causes spherical body 48 to come to rest in second seating area 46, thus forcing flushing fluid into flushing space 52. A second flushing fluid source 324 is connected to axial bore 42 of second rod portion 16 whereby flushing fluid is forced through axial bore 42 when first rod portion 12 moves in the direction indicated by arrow 322. Thus, it will be appreciated that flushing fluid is alternately delivered to internal chamber 34 and flushing space 52 from flushing fluid source 310 and second flushing fluid source 324 throughout the cycle of the pump. Further, it will be appreciated that the delivery of flushing fluid from flushing fluid source 310 to flushing space 52 is inherent with the movement of piston portion 14 and does not require any means for pumping or otherwise pressurizing flushing fluid in source 310.

In the preferred embodiment depicted in FIG. 2, housing 20 of the reciprocating pump includes flushing chamber 302, pumping chamber 306, and pumping channel 304. Flushing fluid source 310 is connected to flushing chamber 302 through unidirectional valve 312 which prevents flushing fluid flow from flushing chamber 302 to flushing fluid source 310. Flushing fluid drain 314 permits flushing fluid to be drained from flushing chamber 302 as desired. O ring 316, annular seal 318, and first rod portion 12 provide a fluid-tight seal between flushing chamber 302 and pumping channel 304, as set forth above with respect to FIG. 1. As first rod portion 12 moves in the direction identified by arrow 322, the available volume in flushing chamber 302 is increased due to the partial withdrawal of first rod portion 12 therefrom. The pressure within flushing chamber 302 is correspondingly decreased, drawing flushing fluid from flushing fluid source 310 into flushing chamber 302. When first rod portion 12 moves in the direction identified by arrow 321, there is an increase in pressure within flushing chamber 302, causing unidirectional valve 312 to close and forcing flushing fluid through first end 24 of axial bore 22 to internal chamber 34 of piston portion 14. The flow of flushing fluid through axial bore 22 causes spherical body 48 to come to rest in first seating area 46, thus forcing flushing fluid into flushing space 52. It is again to be appreciated that this flushing action is inherent to the cycle of the pump. Second flushing fluid source 324 is connected to axial bore 42 through second shaft portion 16 such that flushing fluid is forced from axial bore 42 to internal chamber 34 when piston portion 14 moves in the direction indicated by arrow 322. Thus, flushing fluid is provided to flushing space 52 throughout the cycle of the pump.

In the preferred embodiment of the present invention depicted in FIG. 3, housing 20 includes pumping chamber 306 and pumping channel 304. Flushing fluid source 324 provides flushing fluid to axial bore 42, reserve flushing area 72, and flushing space 52 when piston portion 14 moves in the direction of arrow 86. As described in detail above, when piston portion 14 moves in the direction of arrow 80, flushing fluid is forced from reserve flushing area 72 into radially-extending channels 54 and into flushing space 52 as described above.

FIGS. 5 and 6 depict double acting, reciprocating pumps having inherently flushing piston rods. As discussed in detail above, the piston rod depicted in FIG. 5 is a combination of the piston rods depicted in FIGS. 1 and 2. The structure of housing 20 of the reciprocating pump depicted in FIG. 5 is similarly a combination of structures for housings 20 set forth with respect to FIGS. 1 and 2. Comparably, the piston rod and housing 20 of FIG. 6 are combinations of the piston rods and housings depicted in FIGS. 1 and 3. It is to be appreciated that the piston rods depicted in FIGS. 5 and 6 provide a flushing fluid flow to flushing space 52 which is inherent throughout the cycle of the reciprocating pump. That is, there is no need for a pumping or a pressurizing means for the delivery of flushing fluid to flushing space 52 in these embodiments.

Although the present invention has been described with respect to specific preferred embodiments, various changes and modifications may be suggested to one skilled in the art and it is intended that the present invention encompass such changes and modifications as fall within the scope of the appended claims.

What is claimed is:

1. An inherently flushing piston rod for use in a reciprocating pump, said piston rod comprising:

a piston portion having an axial bore formed therethrough, said axial bore having a first end and a second end, said first end of said axial bore lying in fluid contact with the external environment of said piston portion;

a flexible diaphragm disposed within said axial bore through said piston portion whereby said flexible diaphragm and said piston portion define a reserve flushing zone;

a pair of annular wiper elements extending radially from said piston portion, said annular wiper elements and said piston portion defining an annular flushing space therebetween;

said piston portion having a radially-extending channel formed therethrough, said radially-extending channel fluidly connecting said axial bore through said piston portion and said annular flushing space; and a means for providing flushing fluid to said second end of said axial bore through said piston portion;

a means for preventing flow from said axial bore through said piston portion to said means for supplying flushing fluid.

2. The inherently flushing piston rod of claim 1, wherein said means for preventing flow from said axial bore to said means for supplying flushing fluid comprises a check valve disposed in said piston portion at the intersection of said axial bore and said means for supplying flushing fluid.

3. The inherently flushing piston rod of claim 1, wherein said piston portion defines a plurality of channels disposed between and fluidly connecting said reserve flushing area and said radially-extending channel.

4. The inherently flushing piston rod of claim 1, wherein said piston portion defines a plurality of radially-extending channels disposed between and fluidly connecting said axial bore and said flushing zone.

5. The inherently flushing piston rod of claim 1, wherein an internal piston is reciprocatingly mounted within said flushing zone whereby said internal piston moves substantially in unison with said flexible diaphragm.

6. The inherently flushing piston rod of claim 1, wherein said means for preventing flow from said axial bore to said means for supplying flushing fluid comprises:

said piston portion having a seating position defined therein at the intersection of said axial bore and said means for supplying flushing fluid;

a spherical body mounted within said axial bore through said piston portion, said spherical body being dimensioned to provide a fluid-tight seal between said means for supply and said axial bore when said spherical body is disposed in said seating position;

an internal piston mounted for reciprocating movement within said flushing zone; and a means for connecting said internal piston and said spherical body.

7. An inherently flushing piston rod for a double acting pump, said piston rod comprising:

a rod portion having a first end and a second end, said first end of said rod portion having a perimeter dimension less than the perimeter dimension of said second end, said rod portion having an axial bore formed therethrough, said axial bore having a first end and a second end, said rod portion having a radially-extending channel formed therethrough, said first end of said axial bore terminating at and fluidly interconnected to said radially-extending channel whereby said radially-extending channel fluidly connects said first end of said axial bore through said rod portion to the external environment of said rod portion;

a piston portion coaxially connected to said second end of said rod portion, said piston portion having an internal chamber formed therein, said internal chamber having a first end and a second end, said second end of said axial bore through said rod portion fluidly interconnected to said first end of said internal chamber, said second end of said internal chamber disposed in communication with the external environment of said piston portion;

a means for preventing flow from said first end of said internal chamber to said axial bore through said rod portion;

a flexible diaphragm disposed within said second end of said internal chamber in said piston portion, said flexible diaphragm and said piston portion defining a reserve flushing zone;

a pair of annular wiper elements extending radially from said piston portion, said annular wiper elements and said piston portion defining an annular flushing space therebetween; and said piston portion having a radially-extending channel formed therethrough, said radially-extending channel fluidly connecting said internal chamber and said flushing space.

8. A reciprocating pump having an inherently flushing piston rod, said pump comprising:

a housing, said housing having a main pumping channel defined therethrough, said housing having a pumping chamber defined therein, said pumping chamber disposed in fluid communication with said main pumping channel;

said inherently flushing piston rod mounted for reciprocating movement through said pumping chamber, said inherently flushing piston rod comprising:

a piston portion having an axial bore formed therethrough, said axial bore having a first end and a second end, said first end of said axial bore lying in fluid contact with the external environment of said piston portion;

a flexible diaphragm disposed within said first end of said axial bore through said piston portion, said flexible diaphragm and said piston portion defining a reserve flushing zone;

a pair of annular wiper elements extending radially from said piston portion, said annular wiper elements and said piston portion defining an annular flushing space therebetween; and said piston portion having a radially-extending channel formed therethrough, said radially-extending channel fluidly connecting said axial bore through said piston portion and said annular flushing space;

a means for providing flushing fluid to said second end of said axial bore through said piston portion;

a means for preventing flow from said axial bore through said piston portion to said means for supplying flushing fluid; and a means for reciprocating said piston.

9. A double acting, reciprocating pump having an inherently flushing piston rod, said pump comprising:

a housing said housing having a first main pumping channel and a second main pumping channel defined therethrough, said housing having a pumping chamber defined therein, said pumping chamber disposed between and in fluid communication with said first and said second main pumping channels, said housing having a flushing chamber and a sealing chamber defined therein, said flushing chamber disposed adjacent said first main pumping channel and coaxial with said pumping chamber, said sealing chamber disposed adjacent to and coaxial with said flushing chamber;

a means for supplying flushing fluid to said flushing chamber;

said inherently flushing piston rod mounted for reciprocating movement through said pumping chamber, said flushing chamber, and said sealing chamber, said inherently flushing piston rod comprising:

a rod portion having a first end and a second end, said rod portion having an axial bore formed therethrough, said axial bore having a first end and a second end, said rod portion having a radially-extending channel formed therethrough, said first end of said rod portion having a perimeter dimension less than the perimeter dimension of said second end, said radially-extending channel fluidly connecting said first end of said axial bore through said rod portion to the external environment of said rod portion;

a piston portion coaxially connected to said second end of said rod portion, said piston portion having an internal chamber formed therein, said internal chamber having a first end and a second end, said second end of said axial bore of said rod portion fluidly interconnected to said first end of said internal chamber, said second end of said internal chamber disposed in communication with the external environment of said piston portion;

a means for preventing flow from said first end of said internal chamber to said axial bore through said rod portion;

a flexible diaphragm disposed within said second end of said internal chamber in said piston portion, said flexible diaphragm and said piston portion defining a reserve flushing zone;

a pair of annular wiper elements extending radially from said piston portion, said annular wiper elements defining an annular flushing space therebetween;

said piston portion having a radially-extending channel formed therethrough, said channel fluidly connecting said internal chamber and said flushing space;

a means for fluidly sealing said sealing chamber relative to said flushing chamber;

a means for fluidly sealing said first main pumping channel relative to said first flushing chamber; and a means for reciprocating said piston.

* * * * *